US005492286A

United States Patent [19]

Motta

[11] Patent Number: 5,492,286

[45] Date of Patent: Feb. 20, 1996

[54] THREAD BRAKE

[75] Inventor: Bruno Motta, Pregassona, Switzerland

[73] Assignee: Sobrevin Société de brevets industriels-Etablissement, Vaduz, Liechtenstein

[21] Appl. No.: 133,523

[22] Filed: Oct. 7, 1993

[30] Foreign Application Priority Data

Nov. 9, 1992 [DE] Germany ..... 9215226 U

[51] Int. Cl.[6] ..... B65H 59/22; B65H 59/20

[52] U.S. Cl. ..... 242/419.5; 242/419.4; 242/149; 139/450

[58] Field of Search ..... 242/149, 151, 242/152, 156.1, 419.5, 419.4; 139/450

[56] References Cited

U.S. PATENT DOCUMENTS

| | | | |
|---|---|---|---|
| 2,952,393 | 9/1960 | Newton | 242/151 |
| 4,249,580 | 2/1981 | Budzyna | 139/450 |
| 4,641,688 | 11/1990 | Gehring | 139/450 |
| 4,969,489 | 11/1990 | Tanaka et al. | 139/450 |
| 5,002,089 | 3/1991 | Desmet et al. | 139/450 X |
| 5,179,980 | 1/1993 | Hubner et al. | 242/149 X |
| 5,226,459 | 7/1993 | De Ro et al. | 139/450 |
| 5,305,966 | 4/1994 | Motta | 242/149 |
| 5,363,883 | 11/1994 | Weidmann | 242/149 X |

FOREIGN PATENT DOCUMENTS

| | | | |
|---|---|---|---|
| 0384502 | 8/1990 | European Pat. Off. . | |
| 0453012 | 10/1991 | European Pat. Off. . | |
| 0524429 | 1/1993 | European Pat. Off. . | |
| 2375366 | 7/1978 | France . | |
| 2131302 | 12/1972 | Germany | 242/149 |
| 9113430 | 12/1992 | Germany . | |

*Primary Examiner*—Daniel P. Stodola
*Assistant Examiner*—Michael R. Mansen
*Attorney, Agent, or Firm*—Martin A. Farber

[57] ABSTRACT

An apparatus for the variable braking of traveling threads, wires, or the like, in particular for use in connection with the introduction of the filling thread in looms, in which the thread (F) passes between two brake parts which can be brought into spring application against each other, one of which forms a spring element and the other an abutment, one of the brake parts being movable in order to vary the braking. In order to improve the efficiency, it is provided that the abutment is developed as a substantially cylindrical body (2) which is acted on rotatably by the spring element (1), having a first partial section (4, 5) which is substantially circular in cross section and a second partial section (8) which has at least one circumferential region (6, 7) of reduced cross section, the abutment being seated on the shaft (1) of an electric motor which is developed as stepping motor (9).

6 Claims, 4 Drawing Sheets

THREAD BRAKE

FIELD AND BACKGROUND OF THE INVENTION

The invention relates to a device for the variable braking of traveling threads, wires or the like, particularly for use in connection with the introduction of the filling thread in looms, and to a method for the operating of such a thread brake.

A thread brake is known from French Patent Application 23 75 366. In that case, the thread is passed between two brake parts which can be brought under spring action towards each other. One of the two brake parts is stationary and not under spring action, while the other brake part is under spring action and is movable with respect to the stationary brake part so that the braking of the thread can be varied by a change in the intensity of the tension of the spring obtained as a result of its movement. The spring-actuated brake part can also be spaced away from the stationary brake part by a push rod, as the result of a cam rocker drive, so that unbraked travel of the thread can be obtained. Such a thread brake has the disadvantage that the force of the spring must be relatively great in order effectively to brake the thread. On the other hand, in order to obtain free travel of the thread, the spring-actuated brake part must be lifted completely away from the stationary brake part. In this connection, the spring of the spring-actuated brake part must be at least partially relaxed. This results in relatively large displacement paths of the push rod which drives the spring-actuated element. Furthermore, limits are set for such an arrangement with regard to the cycle time between the braking and release of the thread since the relaxation of the spring can no longer follow along with high cyclic frequencies.

From European Patent Application 0 384 502 a thread brake is furthermore known in which a rotatable, non-spring-actuated brake part acts on a prestressed spring blade. With this arrangement, however, no cyclic change of the braking of the thread is provided. The rotating cylindrical body which forms the non-spring-actuated brake part serves merely to remove, by rubbing, particles of dust present on the thread.

Another example for the invention was the device for the differential braking of traveling threads proposed in Utility Model 91 13 430 (corresponding to U.S. Pat. No. 5,305,966 issued Apr. 26, 1994) which does not constitute a prior publication or prior art. The device described therein already has a stationary leaf spring which is acted on by a cylindrical brake part. This brake part is driven by an electric motor and has a cylindrical first section the circumferential surface of which holds the spring under pretension in the position of release for the travel of the thread. A second partial section of the body has a circumferential section which is reduced in cross section. The thread passes between this second partial section and the leaf spring. If the cylindrical body is aligned with the window towards the leaf spring, the thread is unbraked. After a further rotation of the rotatable body by a given angular amount, the thread is acted on by the circumferential section of unreduced cross section of the second partial sections so that the thread-braking position is reached, the thread being then clamped between the leaf spring and the cylinder surface. This device operates in fixed-cycle operation, the drive motor traveling back and forth between two stops. In order to obtain a high cyclic frequency, the motor must be strongly accelerated as well as strongly decelerated. The use for instance of mechanical stops for the braking of the motor is not optimal.

SUMMARY OF THE INVENTION

Proceeding from the device known from the aforementioned French Patent Application, the object of the present invention is to improve the efficiency of such a thread brake.

As a result of the development of the invention, the spring-actuated brake part need no longer be moved in order to vary the braking in operation. As a result of the substantially cylindrical first partial section of circular cross section, the spring element is held continuously in an initial tension which can be varied, for instance, by adjustment means. The second partial section, which can also be brought against the spring element has, in circumferential direction, at least one circumferential section of reduced cross section the cross section of which is reduced to such an extent that when it is opposite the spring element a window remains between the circumferential section and the spring element through which window the spring can be pulled unbraked. Upon a further rotation of the abutment, which is of a substantially cylindrical shape, a circumferential section which is not reduced in cross section then comes opposite the spring element so that the thread is clamped between the spring element and the substantially cylindrical body forming the abutment, which results in a braking. In this connection, it can be provided that the leaf spring moves by an amount equal to the thickness of the thread. If the first partial section of the substantially cylindrical abutment is not precisely circular, and if the circumferential section of unreduced cross section of the second partial section passes flush into this first partial section then, upon the entering of the apparatus into the braking position, a deflection of the spring element is effected by an amount equal to the thickness of the thread. As a result of the development of the drive part of the abutment as an electric motor, a stepwise further rotation of the shaft of the electric motor is possible without mechanical stops having to be provided. Starting from a position in which the thread is released and in which the circumferential section of reduced cross section is opposite the spring element, the stepping motor need then only be turned further by a corresponding number of steps, which is effected by a corresponding number of switch pulses until the circumferential region which is no longer of unreduced cross section comes opposite the spring element and the thread braking position is reached. In this connection, a leaf spring, preferably developed curved, can serve as spring element and at the same time as thread guide. Furthermore, a development in which a plurality of cross-section-reducing circumferential surfaces is provided in the circumferential direction is preferred. Between these circumferential surfaces of reduced cross section there are provided respective circumferential regions of unreduced cross section. Here also, when a circumferential surface of reduced cross section is opposite the spring element, a thread-release position is present, while when a circumferential region of unreduced cross section is opposite the spring element the thread is clamped between the abutment and the spring element. A particularly advantageous development of the invention consists therein that the number of steps of the stepping motor is equal to at least twice the number of circumferential sections of reduced cross section. As a result of this development, the stepping motor need in each case be moved further only by a single step. If, for instance, two circumferential surfaces of reduced cross section which are preferably arranged opposite each other are provided, between which corresponding circumferential regions of unreduced cross section which are also arranged opposite each other are present, then the number of steps of the motor is equal to four. This means that, upon each step, the shaft of the stepping motor is turned by 90°. As a whole, therefore, in order to effect one revolution of the shaft of the stepping motor, four steps are necessary. For the development of the circumferential sections of reduced cross section it is proposed, in accordance with a further development of the invention, that these circumferential sections be developed as flattenings arranged transverse to the radius. The transitions to the circumferential sections of unreduced cross sections lying adjacent thereto in the circumferential direction could be rounded in order to assure gentle treatment of the thread, The stepping motor preferably has a magnetically polarized armature. This armature can, in one very simple embodiment, be developed as a permanent magnet. In such case the orientation of the magnet is radial to the axis. Around the armature, this preferred stepping motor has an exciting coil which extends in circumferential direction and is divided into a number of partial windings which corresponds to the number of steps of the electric motor. The annular coil core of the exciting coil has opposite pairs of poles associated with the individual step positions of the electric motor. Between these pairs of poles the armature of the electric motor is oriented in accordance with the polarization of the exciting coil. If the exciting coil, for instance, consists of an annular coil core having a total of four poles arranged 90° apart and between each of which a partial winding is provided, and if the armature is to be held between two of these poles by magnetic forces, then the partial windings arranged between these two opposite poles are polarized in the same direction so that a magnetization parallel to the magnetic field of the armature is built up. If the armature is now turned further by one step, in this case by 90°, the second pair of poles which lies transverse to the first pair of poles is correspondingly magnetized. The partial windings present between these two poles are now traversed by current in the same direction so that a magnetic field which is directed between these two magnet poles is produced. As soon as this new flow of current has taken place, the armature orients itself in its new position corresponding to the rotated magnetic field Further rotation of the armature accelerated from the old position into the new position is prevented by magnetic holding forces. A magnetic stop is thus established, which prevents the armature from turning further. This stop is greater the greater the magnetic field is.

The method of operating a thread brake corresponding to an apparatus in accordance with the invention consists therein that, upon each step of the stepping motor, the thread brake passes alternately from a braking position into a position of release, in which connection, starting from a braking position which corresponds to a step position of the electric motor in which an unreduced region of the circumference comes opposite the thread element, upon the following step of the electric motor a region of reduced cross section is brought opposite the spring element. As a result of these method steps, the direction of rotation of the electric motor need not change after passage from the braking position into the release position. Rather, the electric motor can be operated at all times with the same direction of rotation. This permits the magnetic holding of the armature in each step position.

The body forming the abutment is in this connection rotated cyclically, namely step by step.

BRIEF DESCRIPTION OF THE DRAWINGS

With the above and other and other advantages in view, the present invention will become more clearly understood in connection with the detailed description of the preferred embodiment, when considered with the accompanying drawings, of which.

DETAILED DESCRIPTION OF THE PREFERRED EMBODIMENT

Figure 1:
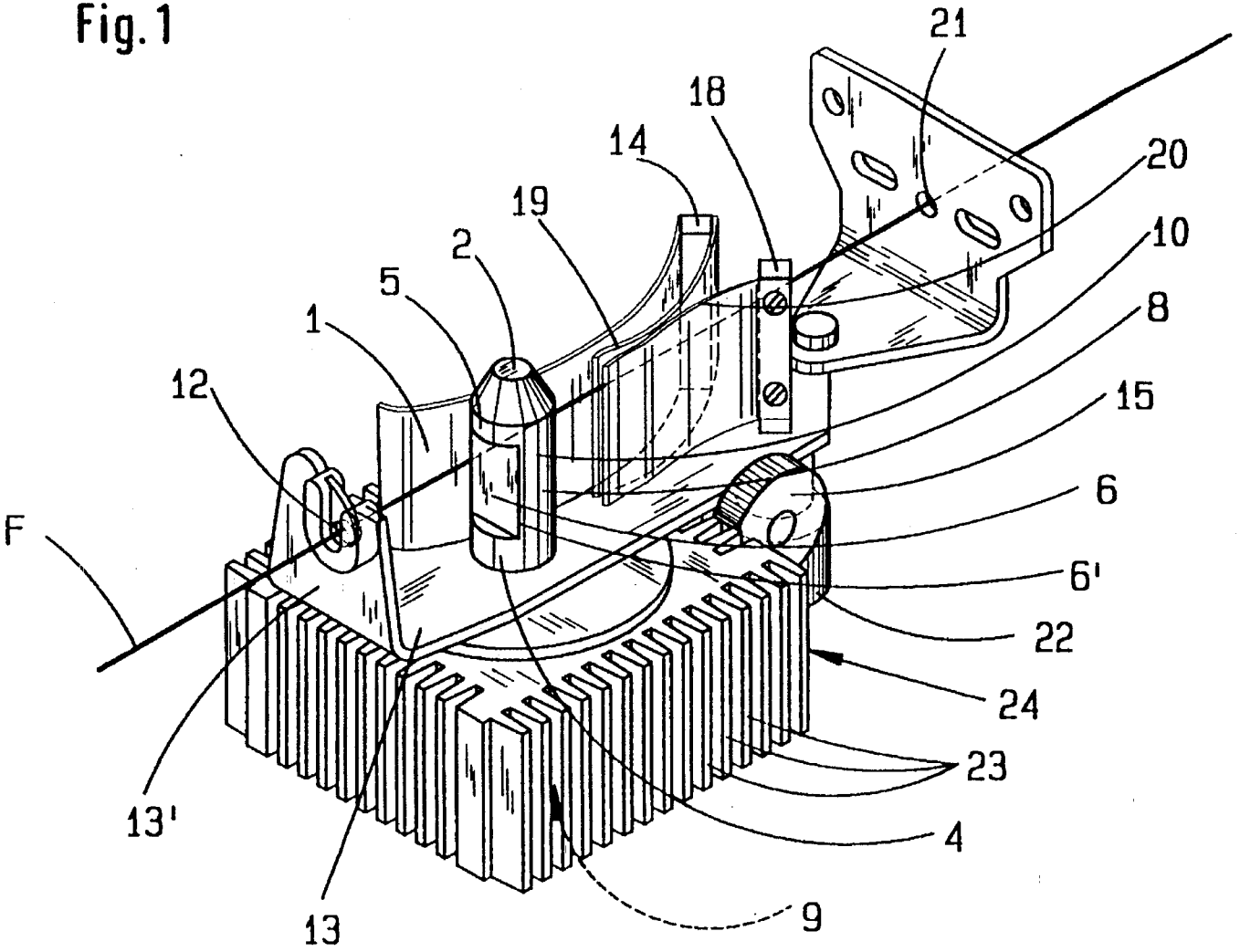
FIG. 1 is a perspective view of a thread brake in accordance with the invention.
Figure 3:
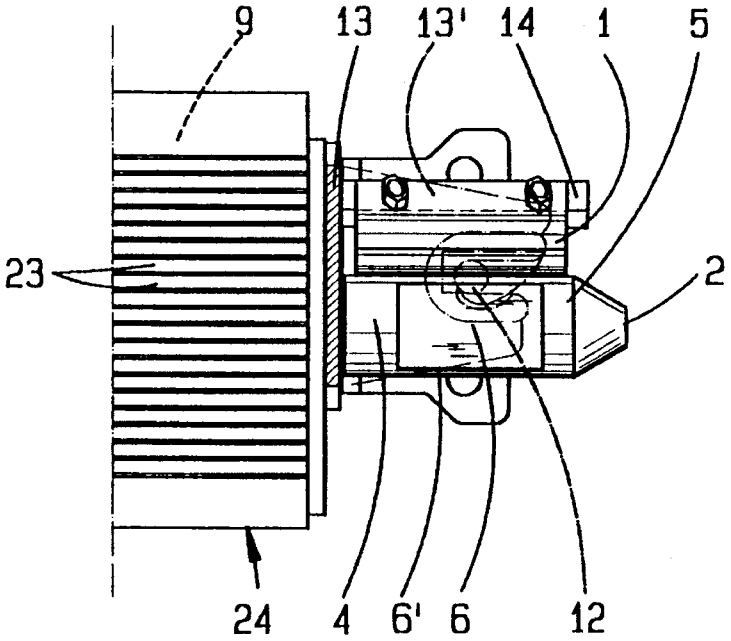
FIG. 3 is a side view of an apparatus according to FIG. 1, shown in braking position.
Figure 2:
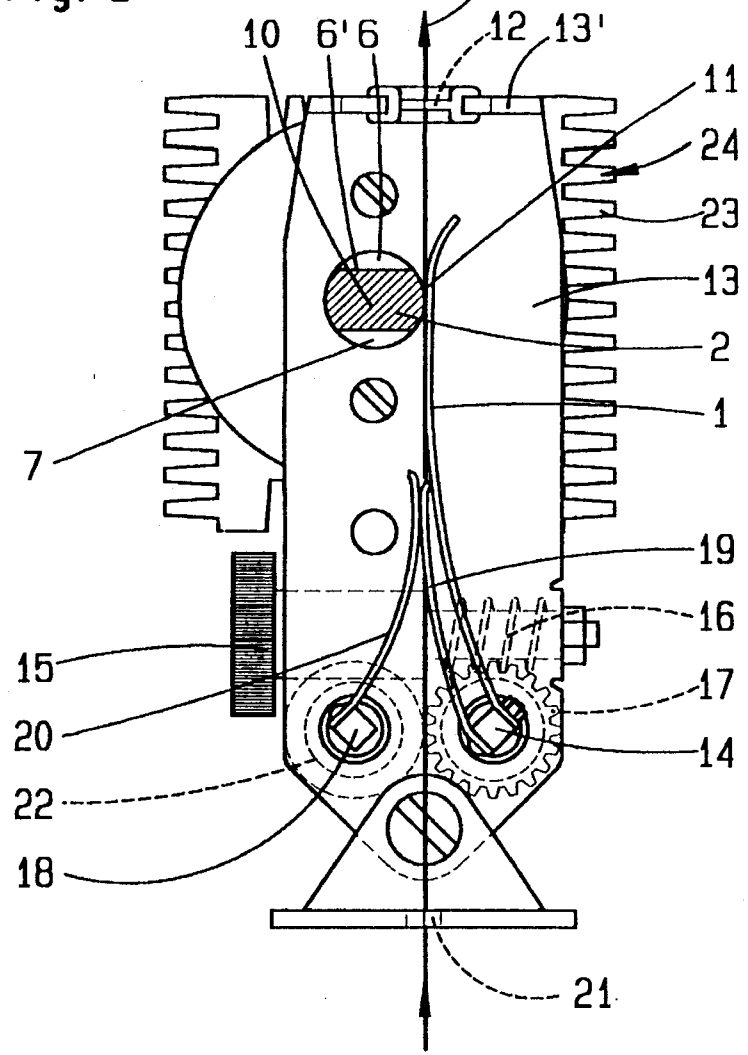
FIG. 2 is a top view of an apparatus in accordance with FIG. 1, shown in braking position.

The apparatus shown in FIGS. 1 to 5 has a motor block 24 which is developed with cooling ribs 23 on its outer side. The motor block is formed of aluminum. A motor shaft (not shown in FIGS. 1 to 5) which bears a substantially cylindrical body 2 extends from one side of the motor block. The cylindrically shaped body 2 forms the abutment for a spring blade 1 which clamps the thread F between itself and the abutment 2 in the braking position (FIG. 2). The blade 1 is borne by a substantially U-shaped support plate 13, the bottom surface of which is screwed onto the motor housing 24. The bottom surface of the support 13 is passed through by the shaft of the motor.

On one of the U-arms 13' of the support 13 there is a thread-withdrawal eye 12 through which the thread F which enters through the thread opening 21 of the opposite U-arm is drawn off after it is pulled through the pre-brake formed by the two facing spring blades 19 and 20 and the actual thread brake, formed by the blade 1 and the body 2.

Thread withdrawal opening 12, thread brake and thread entrance opening 21 lie approximately on a straight line.

The above-indicated pre-brake consists of two spring blades, 19, 20 which are urged by spring action against each other and are screwed on respective square shafts 18, 14. In this connection, the square shaft 18 is swingably displaceable, for instance opposite the square shaft 14 by means of an adjustment wheel 22. The square shaft 14, which is also swingably displaceable by the adjustment wheel 15 and the worm gearing 16, 17, bears, in addition to the blade 19, also the blade 1. The two blades are in this connection screwed onto opposite surfaces of the square shaft 14. By displacement of the adjustment wheel 15, the strength with which the spring blade 1 rests against the abutment 2 can thus be adjusted. By means of the adjustment wheel 22 the strength of the pre-brake can be adjusted by tensioning the spring blade 20.

All three spring elements 1, 19, 20 have substantially the same stiffness and the same width, which covers the partial sections 4, 5, 8 of the body 2. Between the partial sections 4, 5 of the body 2 which have a circular cross section the partial section 8 is present. The partial section 8 has, in circumferential direction, in each case two opposite circumferential sections 6, 7 of reduced cross section. These circumferential sections are formed by flattenings which are arranged substantially transverse to the radius and have roundings 6', not shown in the drawings, in the transition region to the sections 10, 11 of unreduced cross section of the body 2. The circumferential sections 6, 7 of reducing cross section form windows through which the thread can be pulled, without rubbing, in the position of release (see FIGS. 4 and 5).

The pre-brake, which consists of the spring blades (leaf springs) 20 and 19, can be brought out of action by suitable displacement of the adjustment wheel 22 and swinging of the spring blades 19, 20, the spring blade 20 being namely moved away from the spring blade 19.

Figure 5:
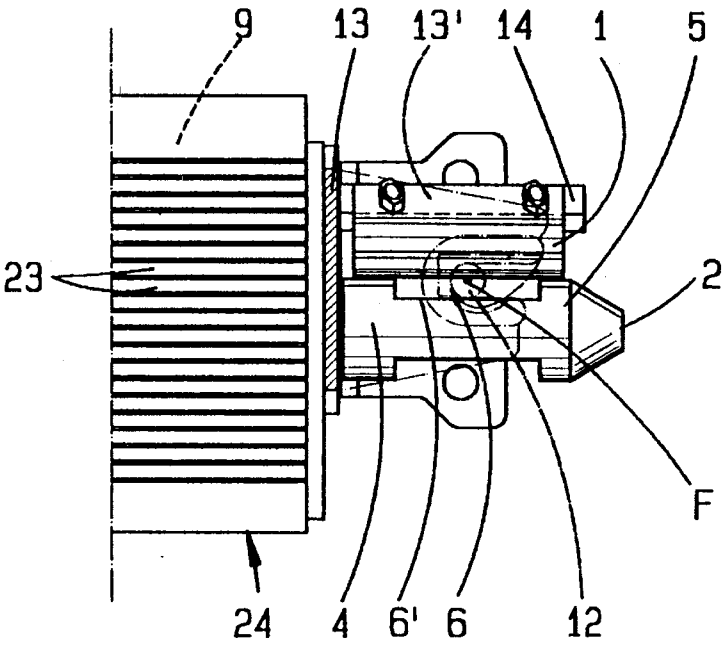
FIG. 5 is a showing in accordance with FIG. 3, in released position.
Figure 4:
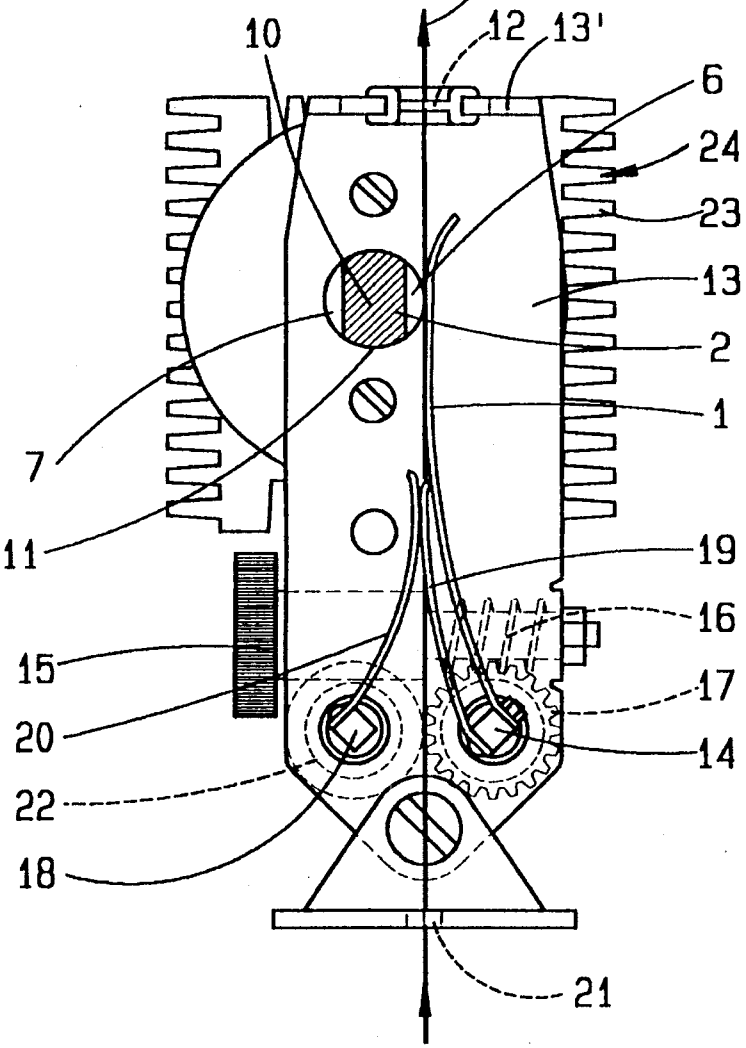
FIG. 4 is a showing in accordance with FIG. 2, in released position.

In accordance with the embodiment shown in the drawing, the first partial section of the substantially cylindrical body which forms the abutment consists of two circular sections 4, 5. These circular sections 4, 5 have the result that, even in a position such as shown in FIGS. 4 and 5, the leaf spring 1 remains in a prestressed position. The sections 4 and 5 extend horizontal to the axis of rotation of the body 2. A minimal change in the position of the spring 1 takes place in the braking position (see FIGS. 2 and 3), namely when the thread is clamped between one of the circumferential sections 10 or 11 of unreduced cross section and the blade 1. The blade can, in this connection, be deflected by the thickness of the thread F. In this connection, a lifting of the blade 1 from the two sections 4 and 5 of circular cross section can also be noted at the same time.

The manner of operation of the apparatus is as follows: The thread passes from the entrance eye 21 through the brake and is fed to a loom or the like (not shown). In the position of the body 2 shown in FIGS. 2 and 3, the spring blade 1 is acted on by the circumferential section 11 of unreduced cross section of the second partial section 8, clamping the thread F. In this position, the thread is braked. In this position the thread is not withdrawn but merely held under a certain thread tension on the side of the thread entrance eye 21. On the other hand, if the thread is pulled out from the thread removal eye 12, then the body 2 is displaced by 90°, as a result of which the release position of the thread shown in FIGS. 4 and 5 is reached. Aside from the action of the pre-brake, the thread can now be withdrawn unbraked. In the position shown in FIGS. 4 and 5, the circumferential section 6 of reduced cross section is now opposite the leaf spring 1. Since the reduction in cross section is several times greater than the diameter of the thread, the latter can be withdrawn practically without friction in the window formed by the reduction in cross section. Due to the circular sections 4 and 5 which act on the blade 1 in this position, the blade remains substantially at rest in the same position.

By continuous displacement of the body 2, retaining the same direction of rotation, by in each case a 90° rotation, a braking position and a release position of the thread are then alternately assumed. The direction of rotation can in this connection be parallel to the travel of the thread or opposite to the travel of the thread. This cyclic further switching of the body 2 is effected by a stepping motor which is arranged in the motor housing 23 and designated by the reference numeral 9. This stepping motor has four steps. This means that the shaft is rotated 90° upon each step. Each step of the stepping motor thus corresponds to a transition from a braking position into a release position, or vice versa.

Figure 6:
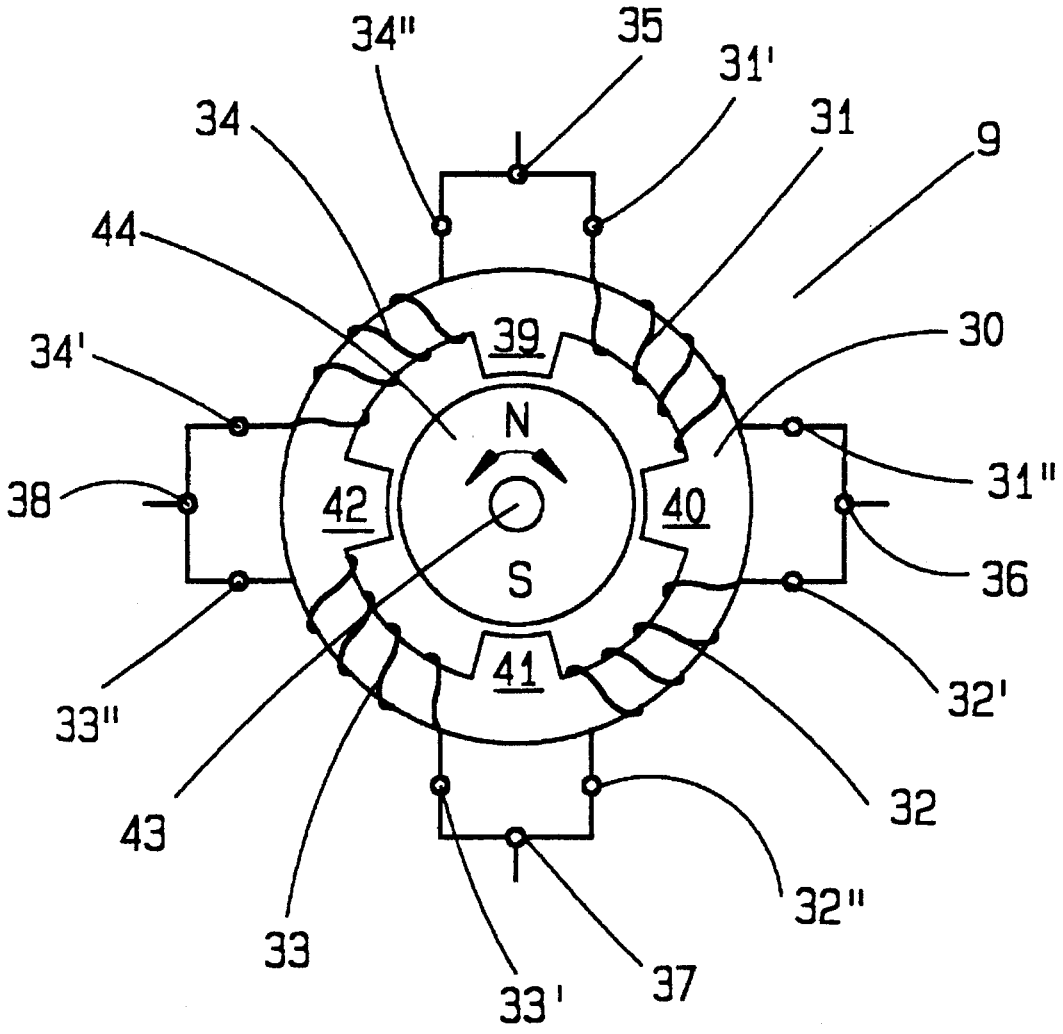
FIG. 6 is a diagrammatic showing of a four-pole stepping motor.

The construction of the stepping motor 9 is diagrammatically shown in FIG. 6. The armature 44, which is developed as a permanent magnet directed transverse to the axis of rotation, is seated on the shaft 43 which is mounted rotatably in the motor housing. The armature is surrounded by an annular core 30 of an exciting coil. The exciting coil consists of a total of four individual regions each covering an angle of 90°. Each partial region has a partial coil 31, 32, 33, 34 and an inwardly extending pole 39, 40, 41, 42. The partial coils 31, 32, 33, 34 are arranged between the four poles 39, 40, 41, 42 which are arranged 90° apart. The ends of adjacent coils—for instance the ends of the coils 31 and 32—are connected to each other, the corresponding ends 31" being connected to the ends 32'. The places of connection of the coils 31, 32, 33, 34 form electric connection contacts 35, 36, 37, 38.

If the position shown in FIG. 6 is to be fixed for instance, i.e. the armature 44 with its north pole facing the pole 39 and with its south pole facing the pole 41, then the corresponding electric connections 35 and 37 are acted on by live current in such a manner that a magnetic field which is directed parallel to the magnetic field of the armature 44 is built up by the exciting coil.

If a step in clockwise direction from the position shown in FIG. 6 is to be carried out with the stepping motor 9, then the electric connections 36 and 38 must be acted on by live current so that a magnetic field is built up between the poles 40 and 42. If a corresponding magnetic field has then been built up between the opposing poles 40 and 42, the armature 44, corresponding to its magnetization, endeavors to direct itself in this magnetic field. This has the result that the armature 44 turns 90° in clockwise direction. North pole and south pole of the armature are thereby displaced out of the orientation to the also opposing poles 39 and 41.

Due to the holding of the armature in the magnetic field built up by the exciting coil, further rotation of the armature as a result of its rotary momentum is prevented. As soon as the armature turns out of the equilibrium position parallel to the exciter magnetic field, the angle of the two magnetic fields produces a moment directed at placing the armature back into its equilibrium position. This backward force forms, so to speak, an electromagnetic stop.

By cyclic change of the action of voltage on the electric connections 35, 36, 37, 38 there is accordingly produced a cyclic rotary field which the armature follows in corresponding fashion.

I claim:

1. In an apparatus for variable braking of traveling threads and the like in connection with the introduction of a filling thread in looms, the thread passing between two brake parts forming a thread brake, with one of the two brake parts being a spring, one of the two brake parts being movable away from the other of the two brake parts to vary the braking, the improvement comprising an electrically rotatable substantially cylindrical body acted on by the spring, said spring comprising a spring blade, said body having a section having at least one circumferential section which is reduced in cross section, and a prebrake comprising two blades which are mounted on bearing axles and swingably adjustable about said bearing axles, said prebrake providing breaking to said thread in series with said thread brake.

2. An apparatus according to claim 1, wherein in circumferential direction of the body there are provided a plurality of said circumferential sections of reduced cross section between each of which there is provided a circumferential section of unreduced cross section.

3. An apparatus according to claim 1, further comprising an electric motor comprising a stepping motor operatively connected to said body and the number of steps of the electric motor corresponds to a multiple of the number of circumferential sections of reduced cross section.

4. An apparatus according to claim 3, wherein the stepping motor has a magnetically, polarized armature formed by a permanent magnet, which is surrounded by an annular core of an exciting coil comprising a number or partial windings corresponding to the number of steps of the stepping motor, and the core forms magnetic poles associated with step positions of the armature.

5. An apparatus according to claim 1, wherein the circumferential section of reduced cross section is flat and arranged parallel to a tangent to the circumference of said body.

6. A method of operating a thread brake comprising two brake parts which can be brought into resilient application, one of which parts forms a spring and the other an abutment, with thread passing through the brake parts, and an electric stepping motor operatively connected to the abutment, the method comprising the steps of while retaining the direction of rotation of the motor, upon each step of the stepping motor changing the braking position of the thread brake alternately from a braking position to a position of release of the thread, wherein, starting from a braking position which corresponds to one step position of the electric stepping motor and in which a circumferential region of unreduced cross section of the abutment is opposite the spring, upon a following step of the electric motor bringing a region of reduced cross section of the abutment opposite the spring.

* * * * *